US005542674A

United States Patent [19]

Kim

[11] Patent Number: 5,542,674

[45] Date of Patent: Aug. 6, 1996

[54] GOLF SWING CORRECTING AND EXERCISING APPARATUS

[76] Inventor: Jin-Man Kim, 276-7, Bora-Ri, Giheung-Eup, Yongin-Kun, Gyunggi-Do, Rep. of Korea

[21] Appl. No.: 403,944

[22] Filed: Mar. 14, 1995

[30] Foreign Application Priority Data

Dec. 21, 1994 [KR] Rep. of Korea ..... 94-35540

[51] Int. Cl.[6] ..... A63B 69/36

[52] U.S. Cl. ..... 473/218; 482/130; 473/240; 473/267; 473/268; 473/272

[58] Field of Search ..... 273/186.2, 191 R, 273/191 A, 192, 186.3, 187 R, 187 B, 187.6, 35 A, 190 R; 482/130

[56] References Cited

U.S. PATENT DOCUMENTS 2,737,432 3/1956 Jenks ..... 273/191 R 3,498,616 3/1970 Hurst ..... 273/186.2

3,604,712 9/1971 Prior et al. ..... 273/191 R X 5,242,344 9/1993 Hundley ..... 273/191 R X

*Primary Examiner*—George J. Marlo

*Attorney, Agent, or Firm*—Nikaido, Marmelstein, Murray & Oram LLP

[57] ABSTRACT

A golf swing correcting health apparatus is disclosed, in which, when a golfer performs a swing within a room, the head-up movement is prevented, further the apparatus can be adjusted in accordance with the physical conditions of the golfer in an accurate manner, and further, the force of the golf club can be adjusted, so that not only the swinging posture can be corrected, but also the athletic exercising effect can be maximized.

1 Claim, 3 Drawing Sheets

GOLF SWING CORRECTING AND EXERCISING APPARATUS

FIELD OF THE INVENTION

The present invention relates to a golf swing correcting health apparatus in which, when a golfer performs a swing within a room, the head-up movement is prevented, further the apparatus can be adjusted in accordance with the physical conditions of the golfer in an accurate manner, and further, the force of the golf club can be adjusted, so that not only the swinging posture can be corrected, but also the athletic exercising effect can be maximized.

BACKGROUND OF THE INVENTION

Generally, prior to going to an actual golf field, a golfer exercises for the correction of the posture and the swinging on an in-door exercising site. However, there are accompanied by a restriction of time, and the problem of expense, with the result that the improvement of the skill of the golfer is delayed, and that the health of the golfer cannot be expected to be improved.

SUMMARY OF THE INVENTION

The present invention is intended to overcome the above described disadvantages of the conventional techniques.

Therefore it is the object of the present invention to provide a golf swing correcting health apparatus, in which the apparatus is installed to the minimum space, so that a golfer may readily exercise swinging, and that the apparatus may be used any time convenient to the user.

Further, the apparatus gives an effect very similar to the swinging at an in-door exercising place or in an actual green field, so that the use efficiency would be improved.

Further, the force of the golf club can be adjusted, and therefore, not only a simple swinging exercise is made possible, but also an athletic exercise is done so as to improve the health of the golfer.

In achieving the above object, the golf swing correcting health apparatus according to the present invention is characterized in that: a head-up preventing cap for preventing the head-up movement during a swinging is flexibly installed on a swing bar support; a swing bar is adjusted by means of a butterfly bolt to move it up and down in accordance with the length of the elbow of the golfer; a lifting rod inserted into a supporting rod is adjusted to move it up and down in accordance with the body length; the swing angle is adjusted by means of a swing angle adjusting butterfly bolt; a tread is adjusted stepwise by means of a tread adjusting rod, utilizing its inner portion as the hinge; the swing posture can be confirmed by utilizing a mirror installed at the leading end of the tread; the end of the swing bar is coupled with a golf club connecting rod by using a joint; the golf club connecting rod and the golf club are inter-connected by means of a hinge; and a magnet is inserted into a grip within the golf club so that a hitting rod generating a hitting noise would be pulled by the magnet.

BRIEF DESCRIPTION OF THE DRAWINGS

The above object and other advantages of the present invention will become more apparent by describing in detail the preferred embodiment of the present invention with reference to the attached drawings in which.

DESCRIPTION OF THE PREFERRED EMBODIMENT

Figure 1:
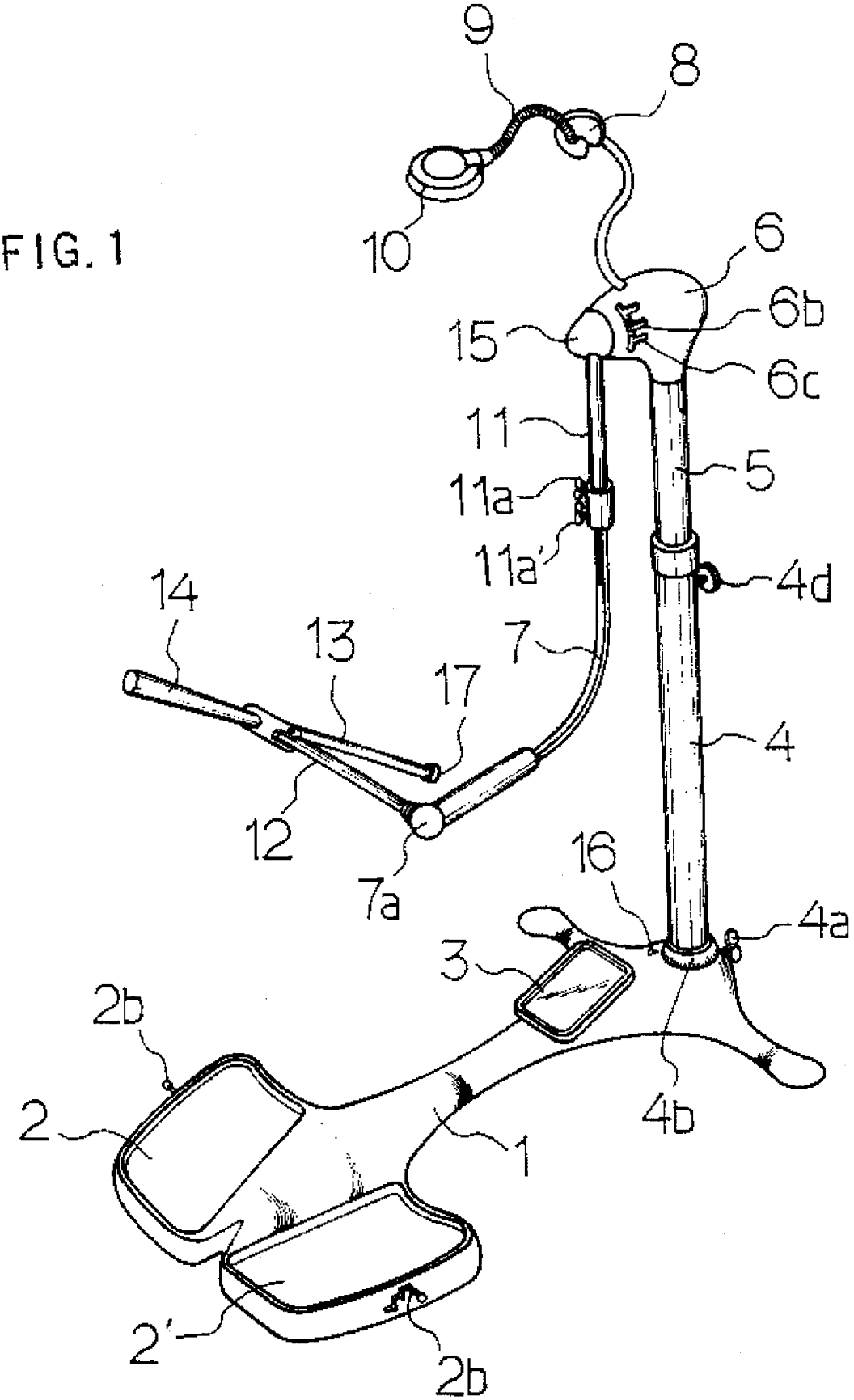
FIG. 1 is a perspective view of the whole unit of the apparatus according to the present invention.
Figure 2:
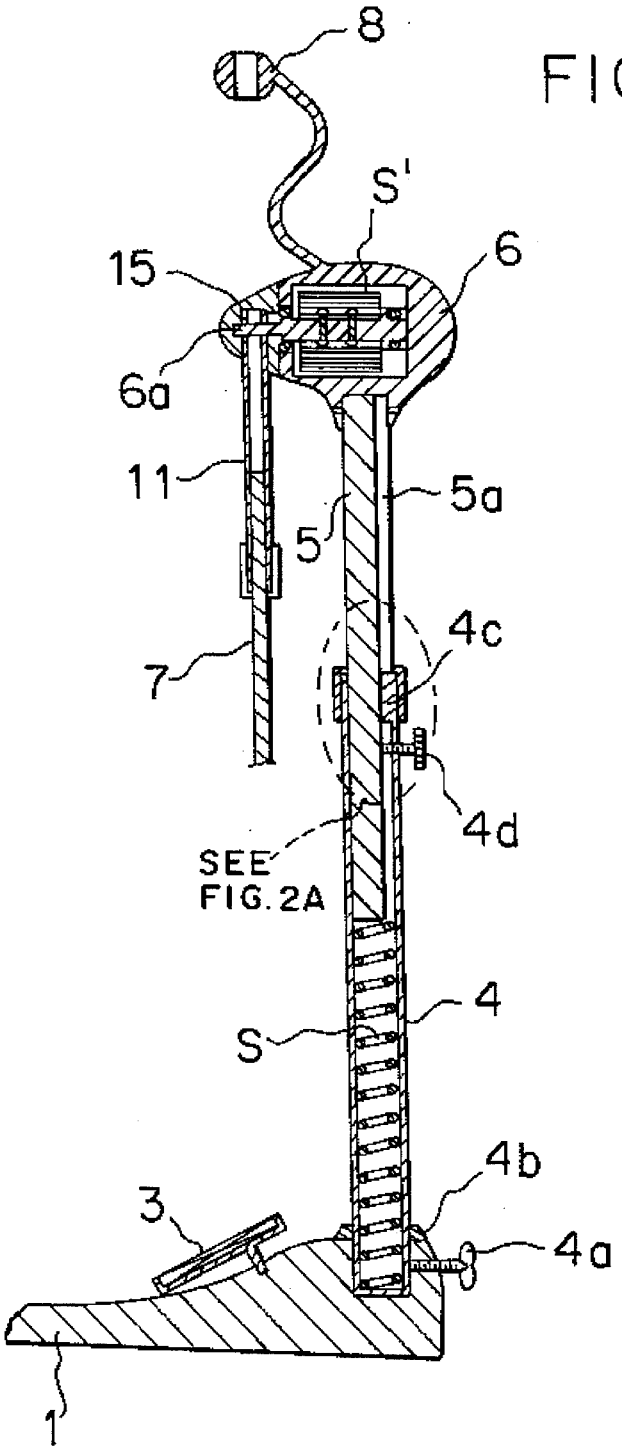
FIG. 2 is a partial side sectional views showing the constitution of the apparatus according to the present invention.
Figure 2A:
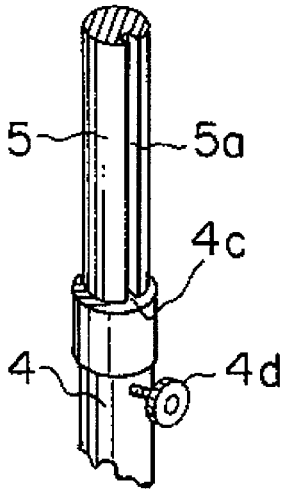
FIG. 2A is a partial perspective detail view of the portion of FIG. 2 surrounded by the dashed line.
Figure 3:
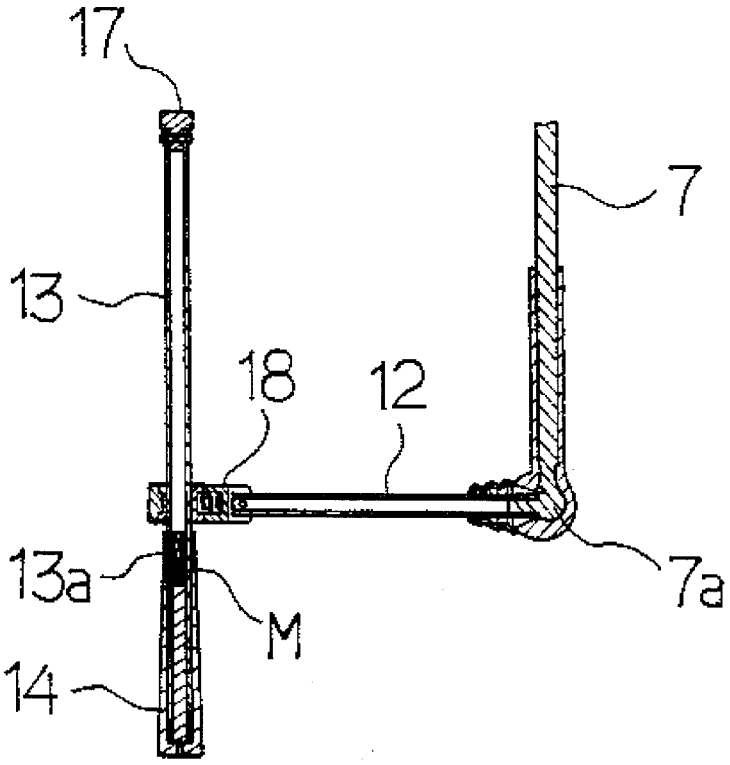
FIG. 3 is a sectional view showing a coupled state of the swing bar and the golf club according to the present invention.
Figure 4:
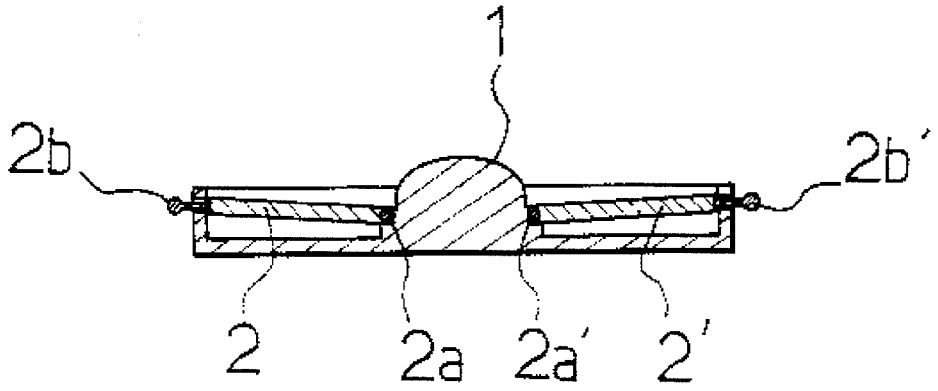
FIG. 4 is a sectional view showing the constitution of the tread according to the present invention.

FIG. 1 is a perspective view of the whole unit of the apparatus according to the present invention.

The golf swing correcting health apparatus according to the present invention includes: treads 2 and 2' mounted on a supporting pad 1; inner hinges **2*a* and 2*a*' and height adjusting hinge bars 2*b* and 2*b*' for adjusting the height of the treads 2 and 2' stepwise; a posture correcting mirror 3 installed at the leading end of the supporting pad 1; a supporting rod 4 connected to the leading end of the supporting pad 1, the supporting rod 4 being adjusted by means of a butterfly bolt; a rubber packing 4*b* disposed at the lower end of the supporting rod 4 and with a swing angle adjusting scale formed thereon; a compression spring S installed within the lower end portion of the supporting rod 4; an elongate projection 4*c* formed on the upper portion of the supporting rod 4; a guide rail 5*a* of the lifting rod 5 coupled with the elongate projection 4*c*; an adjusting bolt 4*d* installed on the outside of the supporting rod 4 for adjusting the height of the apparatus; a force adjusting housing 6 connected to a swing bar 7 and also connected to the lifting rod 5; a shaft 6*a* rivetted to one end of a winding spring S' within the housing 6, the other end of the winding spring S' being connected to a bendable pin 6*b* so as to be disposed within a 3-stage adjusting groove 6*c*; a swing bar support 8 connected through a bent rod to the top of the housing 6; a head-up preventing cap 10 connected through a flexible tube 9 to a side of the swing bar support 8; a swing bar supporting rod 11 connected to the end of the internal shaft 6*a* of the housing 6 so as to install the swing bar 7; butterfly bolts 11*a* and 11*a*' installed at the leading end of the swing bar supporting rod 11 so as to adjust the swing bar 7; a golf club connecting rod 12 connected through a joint 7*a* to the leading end of the swing bar 7; a golf club 13 hinge-coupled with the connecting rod 12; a magnet M installed on a grip 14 within the golf club 13; and a hitting rod 13*a*** gripped by the magnetic force of the magnet M.

In the drawings, reference code 15 indicates a housing rotary cap, 16 indicates a swing angle adjusting mark, 17 indicates a golf club packing, and 18 indicates a golf club hanging device.

The apparatus of the present invention constituted as above will now be described as to its operations.

First, the angle of the feet of the golfer is properly adjusted by manipulating the height adjusting hinge bars **2*b* and 2*b*' around the inner hinges 2*a* and 2*a*' of the treads 2 and 2'. Then the lifting rod 5 is released from the supporting rod 4 by loosening the height adjusting bolt 4*d* in accordance with the stature of the golfer, so that the lifting rod 5 can be moved up and down by the help of the compression spring S. When the lifting rod 5 is adjusted to the required height, the height adjusting bolt 4***c* is tightened. The elbow length adjustment is carried out in a manner as described below. That is, the length adjusting butterfly bolts 11*a* and 11*a*' which are disposed at the leading end of the swing bar supporting rod 11 are loosened, and then, the swing bar 7 is moved vertically by looking at the scales of the upper portion of the swing bar 7 so as to adjust the swing bar 7 to a proper height. After the adjustment, the butterfly bolts 11*a* and 11*a*' are tightened.

The adjustment of the swing angle of the golfer is carried out in a manner described below. That is, the swing angle adjusting bolt 4*a* which is disposed at the leading end of the pad 1 is loosened, and then, the supporting rod 4 is held with hand and rotated by referring to the swing angle adjusting mark 16 to adjust the supporting rod 4. After the adjustment, the butterfly bolt 4*a* is tightened.

After the completion of the basic adjustments as described above, the golfer stands upon the treads 2 and 2'. Then the golfer holds the grip 14 of the golf club 13 in which the golf club 13 and the swing bar 7 are supported by the swing bar support 8 owing to the elastic force of the winding spring S' within the housing 6. Then the golfer turns the golf club 13 by 180 degrees, thereby pulling the golf club 13 to an initial swing position. Then the flexible tube 8 which disposed in the above is adjusted, so that the head-up preventing cap 10 can be adjusted to the head of the golfer, and that the head-up motion can be prevented during the swinging. Thus swinging exercises can be performed.

Under this condition, the hitting posture and the swinging posture of the golfer can be corrected by looking at the posture correcting mirror 3 which is installed at the leading end of the pad 1. Further, the force of the swing bar 7 can be adjusted by stepwise manipulations of the pins 6*b* which are installed on the outside of the housing 6.

During the swinging exercise, the golf club connecting rod 12 is connected through a joint 7*a* to the leading end of the swing bar 7. The golf club connecting rod 12 is hinge-coupled with the golf club 13, and a magnet M is attached on the internal grip 14 of the golf club 13, so that the hitting rod 13*a* can be held by the magnetic force. Then the hitting rod 13*a* departs from the magnet M by the hitting force of the golfer to produce a hitting sound upon being collided with the golf club packing 17. Therefore, a real scene sensation is felt like in an in-door exercising place or a green field, and therefore, the exercising is carried with a high efficiency.

This real scene sensation owes to the fact that a free rotating radius of the joint 7*a* is given, and that the self-rotation of the grip 14 is possible by the help of the vertically rotating golf club hanging device 17 and owing to the hinge-coupling between the golf club 13 and the connecting rod 12.

According to the present invention as described above, the golfer can make motions in a free manner suitably to the physical condition of the golfer within a small space within a room. Further, a real scene sensation is felt like in an in-door exercising place or in a green field, and various weight sensation is felt for the golf club through the adjustment of the winding spring. Thus the swinging exercise can be carried out in an efficient manner, and the motion level can be adjusted, so that the apparatus may serve as a health apparatus.

What is claimed is:

1. A golf swing correcting health apparatus comprising:

treads 2 and 2' mounted on a supporting pad 1; inner hinges 2*a* and 2*a*' and height adjusting hinge bars 2*b* and 2*b*' for adjusting the height of said treads 2 and 2' stepwise;

a posture correcting mirror 3 installed at the leading end of said supporting pad 1;

a supporting rod 4 connected to the leading end of said supporting pad 1, said supporting rod 4 being adjusted by means of a butterfly bolt;

a rubber packing 4*b* disposed at the lower end of said supporting rod 4 and with a swing angle adjusting scale formed thereon;

a compression spring S installed within the lower end portion of said supporting rod 4;

an elongate projection 4*c* formed on the upper portion of said supporting rod 4;

a guide rail 5*a* of a lifting rod 5 coupled with said elongate projection 4*c;* an adjusting bolt 4*d* installed on the outside of said supporting rod 4 for adjusting the height of the apparatus;

a force adjusting housing 6 connected to a swing bar 7 and also connected to said lifting rod 5;

a shaft 6*a* rivetted to one end of a winding spring S' within the housing 6, the other end of said winding spring S' being connected to a bendable pin 6*b* so as to be disposed within a 3-stage adjusting groove 6*c;* a swing bar support 8 connected through a bent rod to the top of said housing 6;

a head-up preventing cap 10 connected through a flexible tube 9 to a side of said swing bar support 8;

a swing bar supporting rod 11 connected to the end of said internal shaft 6*a* of said housing 6 so as to install said swing bar 7;

butterfly bolts 11*a* and 11*a*' installed at the leading end of said swing bar supporting rod 11 so as to adjust said swing bar 7;

a golf club connecting rod 12 connected through a joint 7*a* to the leading end of said swing bar 7;

a golf club 13 hinge-coupled with said connecting rod 12;

a magnet M installed on a grip 14 within said golf club 13; and a hitting rod 13*a* gripped by the magnetic force of said magnet M.

* * * * *